US005222352A

United States Patent [19]

Stahlecker

[11] Patent Number: 5,222,352

[45] Date of Patent: Jun. 29, 1993

[54] PROCESS AND AN ARRANGEMENT FOR SPINNING STAPLE FIBERS INTO A YARN

[75] Inventor: Fritz Stahlecker, Josef-Neidhart-Strasse 18, 7345 Bad Überkingen, Fed. Rep. of Germany

[73] Assignees: Fritz Stahlecker; Hans Stahlecker, both of Fed. Rep. of Germany; a part interest to each

[21] Appl. No.: 689,501

[22] Filed: Apr. 23, 1991

[30] Foreign Application Priority Data

Apr. 28, 1990 [DE] Fed. Rep. of Germany ..... 4013689

[51] Int. Cl.[5] ..... D01H 1/115; D01H 4/02; D01H 4/06

[52] U.S. Cl. ..... 57/403; 57/333; 57/409; 57/412

[58] Field of Search ..... 57/400, 401, 403, 404, 57/406, 407, 409, 412, 333, 328

[56] References Cited

U.S. PATENT DOCUMENTS

| | | | |
|---|---|---|---|
| 3,855,772 | 12/1974 | Burlet | 57/328 X |
| 3,998,040 | 12/1976 | Ripka et al. | 57/409 |
| 4,044,537 | 8/1977 | Negishi et al. | 57/406 |
| 4,507,913 | 4/1985 | Morrison | 57/401 X |
| 4,539,806 | 9/1985 | Stahlecker | 57/409 X |
| 4,660,371 | 4/1987 | Stalder | 57/412 X |
| 4,724,668 | 2/1988 | Wassenhoven | 57/400 X |
| 4,753,066 | 6/1988 | Briner et al. | 57/409 X |
| 5,090,192 | 2/1992 | Stalecker | 57/333 X |

FOREIGN PATENT DOCUMENTS

| | | | |
|---|---|---|---|
| 0236324 | 3/1989 | European Pat. Off. . | |
| 3624190 | 1/1987 | Fed. Rep. of Germany . | |
| 3901791 | 8/1989 | Fed. Rep. of Germany . | |
| 1231198 | 5/1971 | United Kingdom | 57/401 |
| 2178451 | 2/1987 | United Kingdom | 57/400 |

*Primary Examiner*—Joseph J. Hail, III
*Attorney, Agent, or Firm*—Evenson, McKeown, Edwards & Lenahan

[57] ABSTRACT

A process and an arrangement for the spinning of staple fibers into a yarn is disclosed in which sliver-shaped fiber material is opened up into individual fibers which are fed to a collecting surface which moves at a speed which corresponds to at least the feeding speed of the individual fibers. The collecting surface conveys the fibers to a withdrawal point with the collecting surface tapering between the feeding point and the withdrawal point. The collecting surface operates to bundle the fibers during the conveying to the withdrawal point to form a fiber composite which is withdrawn at the withdrawal point while receiving a twist. It is provided that the withdrawal of the fiber composite at the withdrawal point takes place in a direction which corresponds essentially to the conveying direction of the fiber composite on the collecting surface, a withdrawal speed being provided which is essentially equal to the conveying speed of the collecting surface.

31 Claims, 5 Drawing Sheets

Fig. 2
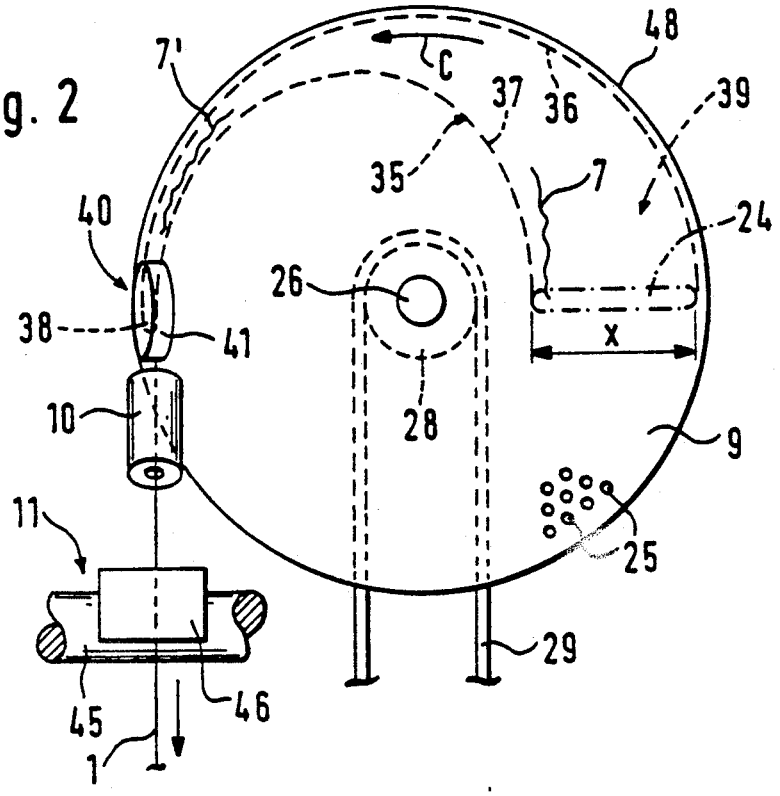
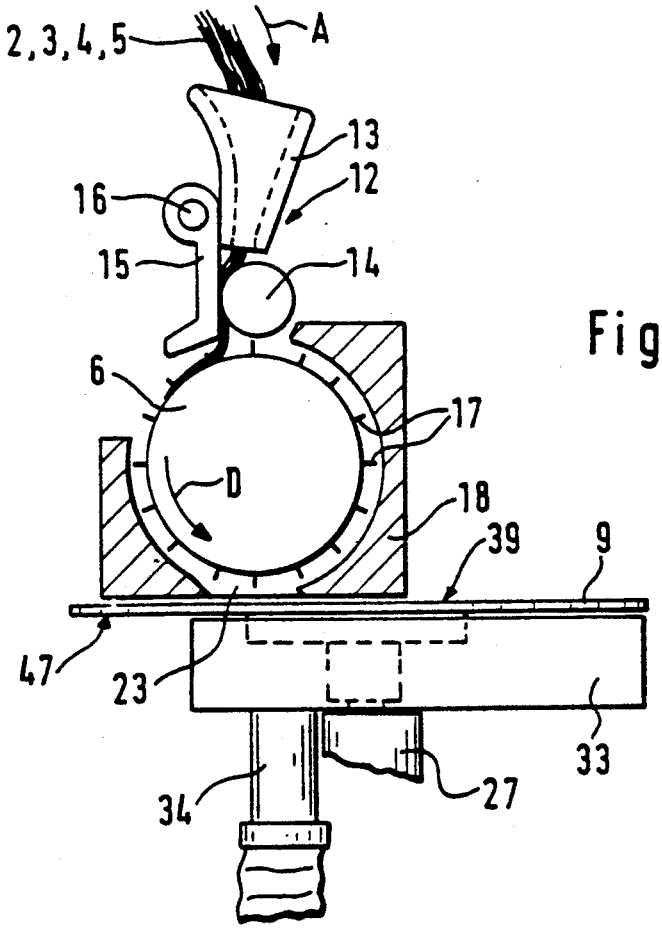
Fig. 3

Fig. 6
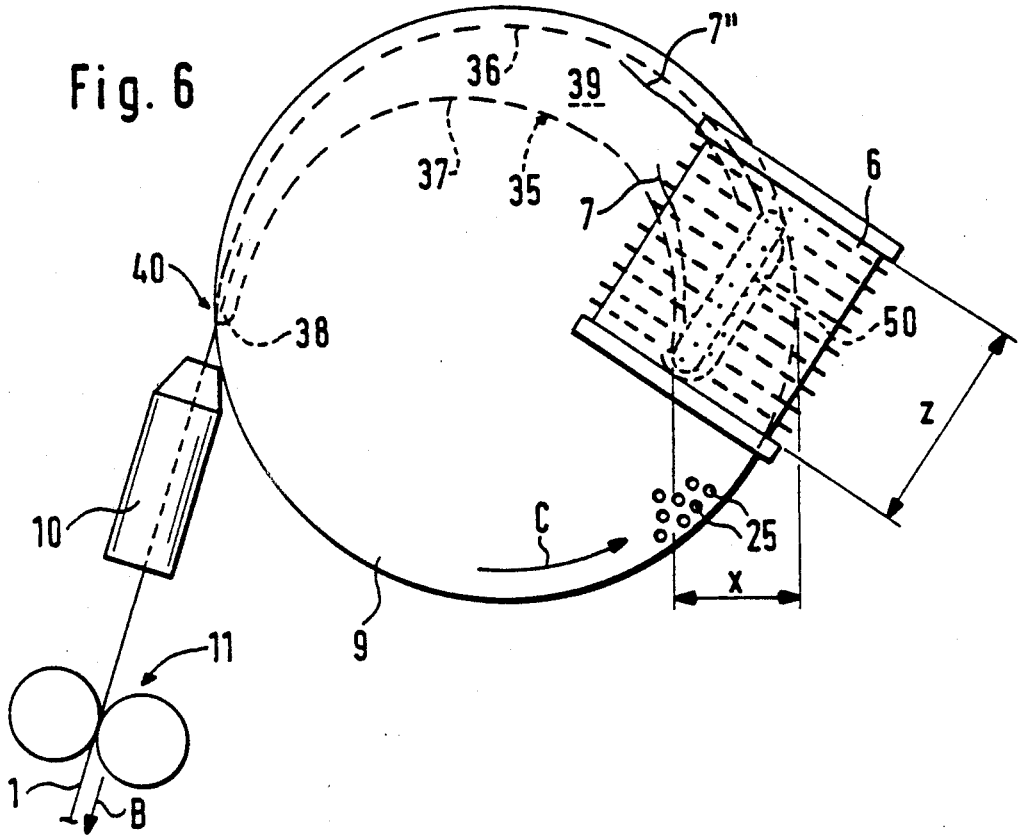
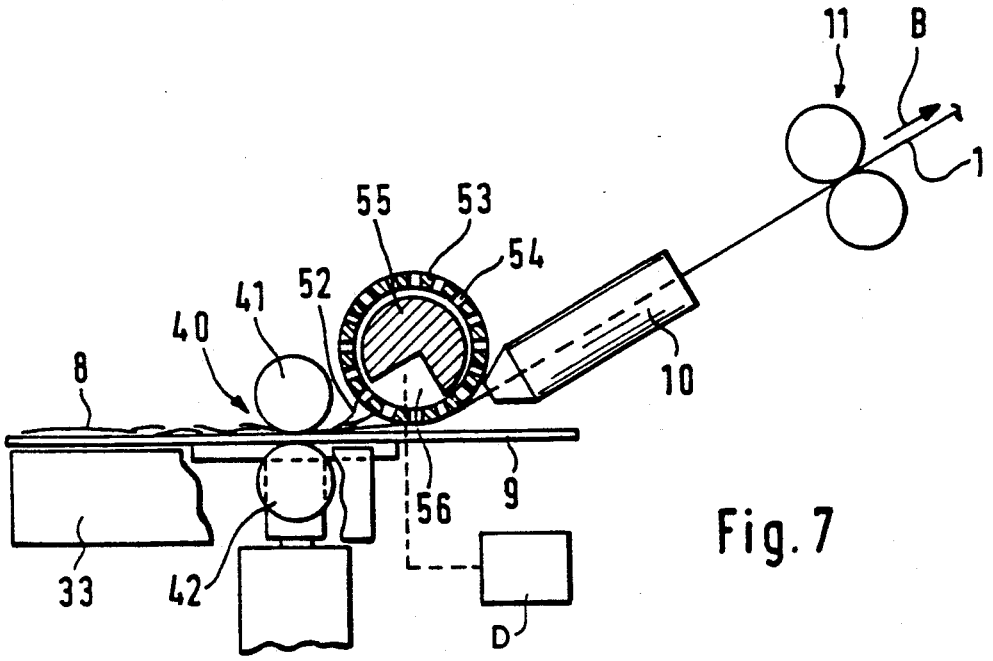
Fig. 7

Fig. 8
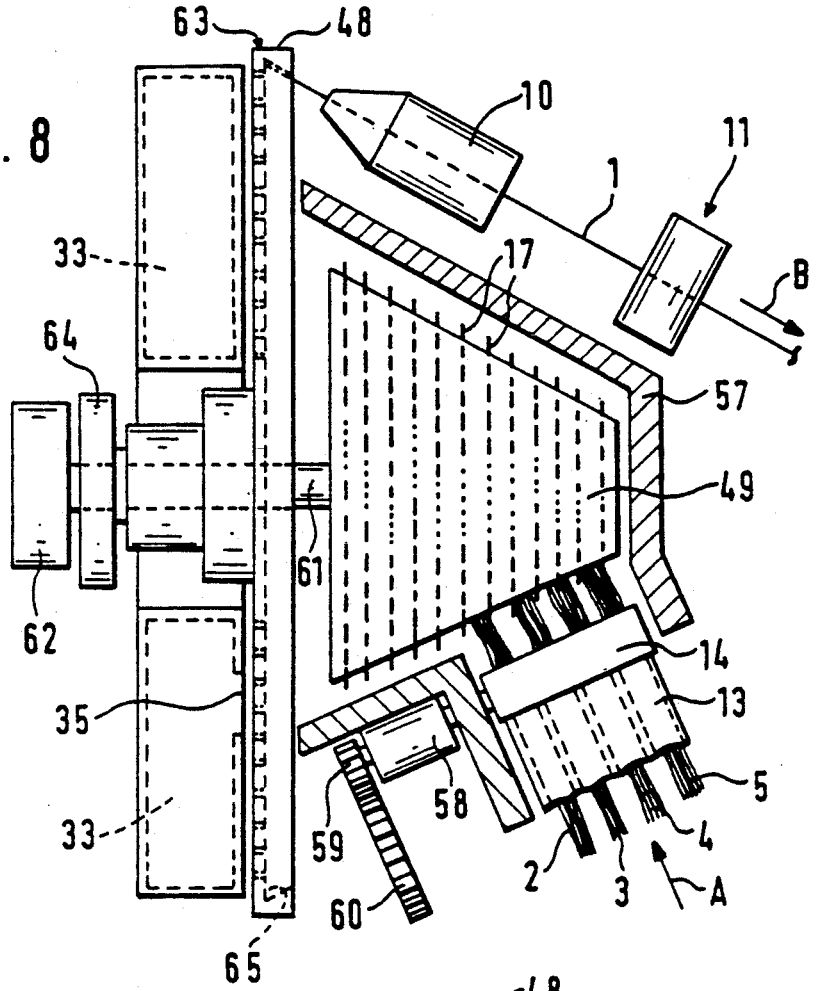
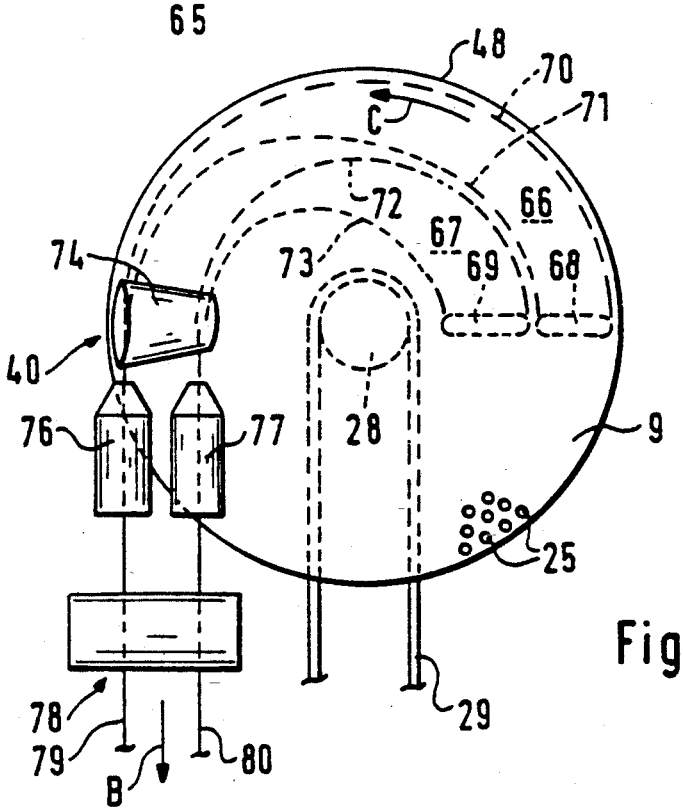
Fig. 9

PROCESS AND AN ARRANGEMENT FOR SPINNING STAPLE FIBERS INTO A YARN

BACKGROUND AND SUMMARY OF THE INVENTION

The invention relates to a process and an arrangement for spinning staple fibers into a yarn, in which sliver-shaped fiber material is opened up into individual fibers which are guided to a collecting surface which moves at a speed which corresponds to at least the feeding speed of the individual fibers and which conveys the fibers to a withdrawal point, the collecting surface tapering between the feeding point and the withdrawal point and, during the conveyance to the withdrawal point, bundling the fibers into a fiber composite which is withdrawn at the withdrawal point while receiving a twist.

In the case of a process and arrangement of this type, as it is known from the German Patent Document DE-A 36 24 190, a drafting of the fed fiber material takes place to the desired yarn size with an opening-up into individual fibers. The individual fibers are fed to the collecting surface in an amount which corresponds to the yarn size to be spun so that a subsequent doubling is avoided which is always connected with the danger of a tangled position of the fibers. The separated fibers are then only bundled into a fiber composite transversely with respect to the direction of the continued conveyance. In the known construction, it is provided that the bundled fiber composite, while a twist is introduced simultaneously, is withdrawn against the moving direction by which it moves on the collecting surface.

It is also known from European Patent Document EP-B 0 236 324 to double the separated fibers on a collecting surface so that the desired yarn size is obtained. The collecting surface then conveys the fiber composite to a withdrawal point at which the fiber composite is withdrawn in the direction in which it is fed while a twist is introduced at the same time. In this case, the withdrawal speed corresponds essentially to the feeding speed of the collecting surface.

It is an object of the invention to provide a process and an arrangement of the initially mentioned type by which the yarn quality is further improved by maintaining a parallel position of the fibers.

This object is achieved in that the withdrawal of the fiber composite at the withdrawal point takes place in a direction which corresponds essentially to the conveying direction of the fiber composite on the collecting surface, a withdrawal speed being provided which is essentially equal to the conveying speed of the collecting surface.

By these measures, it is ensured that the fibers, after the separation until the time of the binding into a yarn, by no means, reduce their speed abruptly, but keep it constant or rather accelerate. This achieves that abrupt reversals of movements are avoided which result in backups and tangling of the fibers. Very high yarn delivery speeds may be achieved without the requirement of drafting units for this purpose. In this case, it is advantageous for the fiber material to be fed in the form of several slivers. By means of such a multi-sliver presentation, an effective doubling effect is obtained even before the fibers are separated.

In a further development of the invention, it is provided that a running-back of the twist in the withdrawn fiber composite in the area of the withdrawal point is prevented. This results in a false-twist-spun yarn which consists of an essentially untwisted yarn core and exterior yarn ends wound around it.

In another development of the invention, it is provided that the fiber composite receives a twist which runs back beyond the withdrawal point. As a result, a yarn is obtained which has a true twist, that is, which also is twisted in the yarn core.

In a further development of the invention, it is provided in the case of an arrangement for the spinning of staple fibers into a yarn which has a feeding and opening device which opens up sliver-shaped fiber material into individual fibers, a collecting device which follows and moves essentially in the feeding direction of the individual fibers and which has a collecting surface tapering from a feeding point to a withdrawal point, a withdrawal device which follows the withdrawal point, and a device for providing a twist arranged between the withdrawal point and the withdrawal device, it is provided that the withdrawal device and the device for providing the twist are arranged in such a manner that the withdrawal direction corresponds essentially to the moving direction which the collecting device has in the area of the withdrawal point.

In an advantageous embodiment, it is provided that the collecting device is an axially perforated disk to which a suction device is assigned which is arranged on the side facing away from the feeding and opening device and which has a suction slot tapering from the area of the feeding point to the withdrawal point. In combination with centrifugal forces affecting the fibers, this suction slot causes a bundling of the fibers to a fiber composite.

In a further development of the invention, it is provided that a pressure roller is arranged at the withdrawal point and forms a clamping point with the disk. This pressure roller first has the task of defining the withdrawal point as precisely as possible. When its clamping effect is adjusted to be only slight, the twist given to the withdrawn fiber composite extends back against the withdrawal direction to beyond the withdrawal point in the sliver so that a truly twisted yarn is spun. When, on the other hand, a relatively strong clamping is provided between the pressure roller and the disk, a travelling-back of the twist provided to the sliver in the area of the withdrawal point is largely prevented so that then the device for providing the twist in the withdrawn yarn composite produces only a false twist; that is, a false-twist-spun yarn is produced.

In a further development of the invention, it is provided that the suction slot is extended beyond the withdrawal point. This measure has increased significance particularly if a false-twist spinning is carried out. As a result, it will therefore be possible to spread away, in the area of the extension of the suction slot, fiber ends from the fiber composite which will then result in an improved winding-around.

In a further development of the invention, it is provided that the disk is provided with an essentially axially directed border forming a collecting groove. This collecting groove has the purpose of promoting the bundling of the sliver in a defined area. In this case, it may then be expedient to throttle the suction in front of the withdrawal point or to eliminate it completely. This may, for example, be achieved by the fact that the suction slot changes already in front of the withdrawal point or that the area of the withdrawal point is subjected to a reduced vacuum.

In a further development of the invention, it is provided that a roller, which is subjected to suction and forms a yarn deflection, is arranged between the withdrawal point and the device for providing the twist. This roller is driven to a circumferential speed which is higher than the withdrawal speed. This development is particularly advantageous if a false-twist spinning is carried out. The suction roller has the effect that, at first, some edge fibers are still spread away which are then taken along by the roller, which is subjected to suction, at an increased speed so that then the edge fibers are wound in a defined manner around the fiber composite which rotates as the result of having received a twist.

Other objects, advantages and novel features of the present invention will become apparent from the following detailed description of the invention when considered in conjunction with the accompanying drawings.

BRIEF DESCRIPTION OF THE DRAWINGS

FIG. 2 is a view in the direction of the arrow II of FIG. 1 with the feeding and opening device not shown for the purpose of obtaining a clearer representation;

FIG. 3 is a partially sectional, simplified view taken in the direction of the arrow III of FIG. 1;

FIG. 6 is a schematic view similar to FIG. 2, showing another preferred embodiment of the invention with an oblique opening roller;

FIG. 7 is a schematic view similar to FIG. 4, showing another preferred embodiment of the invention in which a roller, which is subjected to suction, is arranged between a withdrawal point and a device for providing a twist;

FIG. 8 is a schematic partially sectional view of another preferred embodiment of the invention with a truncated-cone-shaped opening roller arranged coaxially with respect to a disk forming a collecting surface; and FIG. 9 is a schematic view similar to FIG. 2 of another preferred embodiment of the invention, in which two yarns are spun, with two collecting surfaces formed on a joint disk by means of two suction slots of a suction device.

DETAILED DESCRIPTION OF THE DRAWINGS

Figure 1:
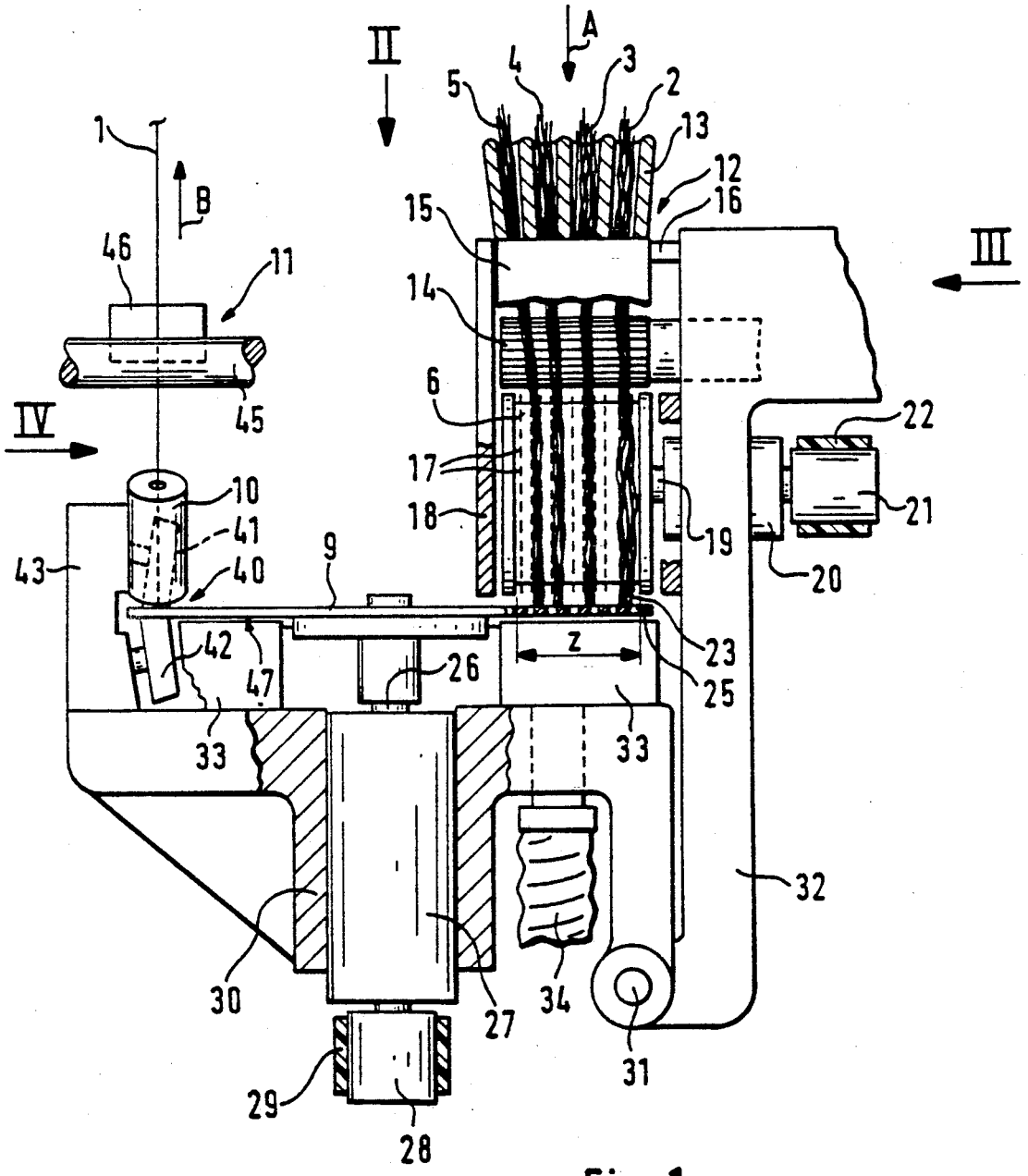
FIG. 1 is a schematic partially sectional view of an arrangement constructed according to a first embodiment of the invention for carrying out a spinning process in which four slivers are fed which are spun into a yarn.

By means of the arrangement according to FIGS. 1 to 4, a yarn 1 is spun which is formed of a total of four slivers 2, 3, 4, 5 fed in the direction of the arrow (A). The slivers 2 to 5 travel side-by-side into a feeding hopper 13 of a feeding and opening device 12, as it is known in principle on the basis of open-end rotor spinning. The feeding hopper 13 is followed by a draw-in roller 14 which maintains the draw-in speed and forms a nip line with a table 15. The table 15, which can be swivelled around a shaft 16 (FIG. 3) is elastically loaded in a manner not shown in detail in the direction of the draw-in roller 14. The fed slivers 2, 3, 4, 5 are offered to an opening roller 6 which has a working width (z) which is dimensioned for a simultaneous combing-out of all slivers 2 to 5. On its circumference, the opening roller 6 is provided with a mounting 17 of needles or saw teeth. It is surrounded at least partially by an opening roller housing 18. It is arranged on a shaft 19 which is disposed in the opening roller housing 18 by means of a bearing housing 20. The shaft 21 is extended toward the outside and is provided with a driving wharve 21 which is driven by a belt 22.

The opening roller housing 18 has a fiber feeding duct 23 which is arranged approximately diametrically opposite the draw-in roller 14 and which is aligned approximately tangentially with respect to the opening roller 6. The very short fiber feeding duct 23 is followed by a disk 9 which takes over the separated fibers, of which one fiber 7 is shown in FIG. 2. The disk 9 is non-rotatably arranged on a shaft 26 which extends perpendicularly with respect to a plane in which the shaft 19 of the opening roller 6 is situated. The shaft 26 is disposed in a bearing housing 27 which is held in a housing 30. The end of the shaft 26 which faces away from the disk 9 projects beyond the bearing housing 27 and the housing 30 and there is provided with a driving wharve 28 against which a driving belt 29 moves along.

As illustrated in FIG. 1, the opening roller housing 18 is mounted on a holder 32 in which the draw-in roller 14 is also disposed which is driven in a manner not shown in detail. This holder 32 is fastened on the housing 30 so that it can be swivelled around a swivel axis 31.

In an annular area which follows its outer circumference 48, the disk 9 is provided with a perforation 25. On the side of the disk 9 disposed opposite the feeding and opening device 12, a stationary suction device 33 is arranged which is carried by the housing 30. This suction device 33 has a chamber which, by way of a vacuum line 34, is connected to a vacuum source which is not shown. This chamber is open in the direction of the disk 9 by means of a suction slot 35. This suction slot 35 starts in the area of the mouth 24 of the fiber feeding duct 23 indicated by a dash-dotted line in FIG. 2 with an initial width (x) which corresponds to at least the working width (z) of the opening roller 6. The outer boundary wall 36 of the suction slot 35 then extends in the circumferential direction (C) of the disk 9 on an orbit, while the inner boundary wall 37 of the suction slot 35 extends along a spiral line.

Together with the perforated disk 9, the suction slot 35 forms a fiber collecting surface 39 which therefore tapers continuously in the circumferential direction of the disk 9 starting from the initial width (x) until, at a withdrawal point 40, there is a width of only a few millimeters. The withdrawal point 40 is approximately diametrically opposite the feeding point determined by the mouth 24 of the fiber feeding duct 23; that is, following a circumferential angle of approximately 180°. The withdrawal point 40 is determined by a slightly conical pressure roller 41 which, by means of an adjustable contact pressure force, is elastically pressed against the surface 9 of the disk 9. The contact pressure roller 41 is held on a holder 43 which is mounted on housing 30 and which receives an also slightly conical counterpressure roller 42 which is arranged on the side of the disk 9 situated opposite the pressure roller 41 and supports it against the load exercised by the pressure roller 41.

Figure 4:
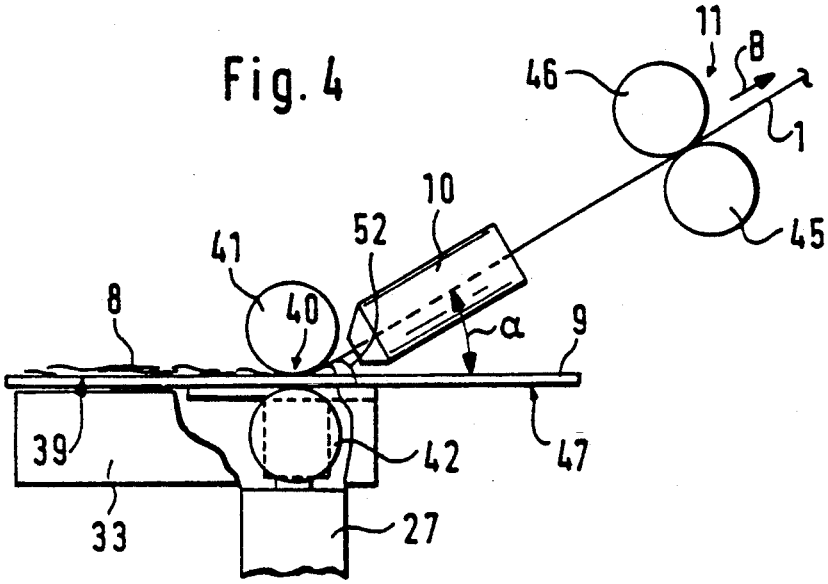
FIG. 4 is a simplified schematic view taken in the direction of the arrow IV of FIG. 1.

The withdrawal point 40 is followed by a withdrawal device 11 which is formed of a driven shaft 45 and an elastically pressed-on pressure roller 46. Between the withdrawal point 40 and the withdrawal device 11, a pneumatic twisting nozzle 10 is arranged which is aligned tangentially with respect to the pressure roller 41 and to the shaft 45 and the pressure roller 46 (FIG. 4).

The fibers 7 combed out of the slivers 2 to 5 by the opening roller 6 normally leave the opening roller 6 at a speed which corresponds to approximately half the circumferential speed of the opening roller 6. They are then taken over by the disk 9 in the area of the collecting surface 39. In the area of the collecting surface 39, the disk 9 has a circumferential speed which corresponds at least to the speed of the arriving fibers 7. The circumferential speed of the initial width (x) of the fiber collecting surface 39 in the area of the smallest radius with respect to the shaft 26 should already have the corresponding speed so that the speed in the area of the larger radii is correspondingly higher. The fibers already fed by the opening roller 6 in the number corresponding to the yarn size are then bundled on the fiber collecting surface 39 and, in the form of a bundled sliver 8, are supplied to the withdrawal point 40. At this withdrawal point 40, the bundled sliver 8 is withdrawn, and receives a twist by means of the twisting nozzle 10. The withdrawal speed of the withdrawal device 11 corresponds to the circumferential speed of the disk 9 in the area of the withdrawal point 40. It is preferably slightly lower in order to receive a slight negative draft here so that the turning-in of the fiber composite into a yarn 1 is facilitated. The twist which is introduced into the fiber composite by the twisting nozzle 10 travels back in the sliver. To what extent this twist axially travels back can be determined by means of a pressure roller. When the pressure roller 41 is adjusted such that it forms a nip line with the disk 9, a travelling-back of the twist beyond the withdrawal point 40 can be prevented. A false-twist spun yarn will then be obtained, that is, a yarn which is similar to pneumatic false-twist spinning. In this case, it is expedient for the suction slot 35 to also have an extension 38 (FIG. 2) extending beyond the withdrawal point 40 by means of which the spreading-away of fiber ends 52 is improved (FIG. 4).

If, on the other hand, the pressure roller 41 is adjusted in such a manner that it exercises only a slight or possibly no clamping pressure on the disk 9, the provided twist in the fiber composite may travel back farther. In this case, a truly twisted yarn is obtained because the fiber composite in the area of the fiber 7' shown in FIG. 2 still has an open end.

The arrangement illustrated in FIGS. 1 to 4 permits a very high spinning speed. When, for example, four slivers 2 to 5 are fed, which each have a yarn size of Nm 0.30, an overall sliver feed of Nm 0.075 is obtained At a draw-in speed of 1.0 m/min of the draw-in roller 14 and at a circumferential speed of the opening roller 6 of 1,500 m/min, a speed for the delivered fibers 7 of approximately 750 m/min. is obtained. Normally, the fibers opened up by opening rollers receive approximately half the circumferential speed of the opening roller. Thus an approximately 750-fold draft is obtained. When the disk 9 is driven in such a manner that a 1.25-fold transfer draft is still obtained, this leads to a 937-fold overall draft. The result will then be yarn 1 with a yarn size of Nm 70 which is produced at a delivery speed of approximately 937 m/min. In order to spin a medium or coarser yarn size, a coarser feed may be provided, while the same conditions are maintained, that is, the feed of slivers 2 to 5 with sliver sizes of Nm 0.25 or 0.2. It is also possible to correspondingly change the draw-in speed of the draw-in roller 14.

Figure 5:
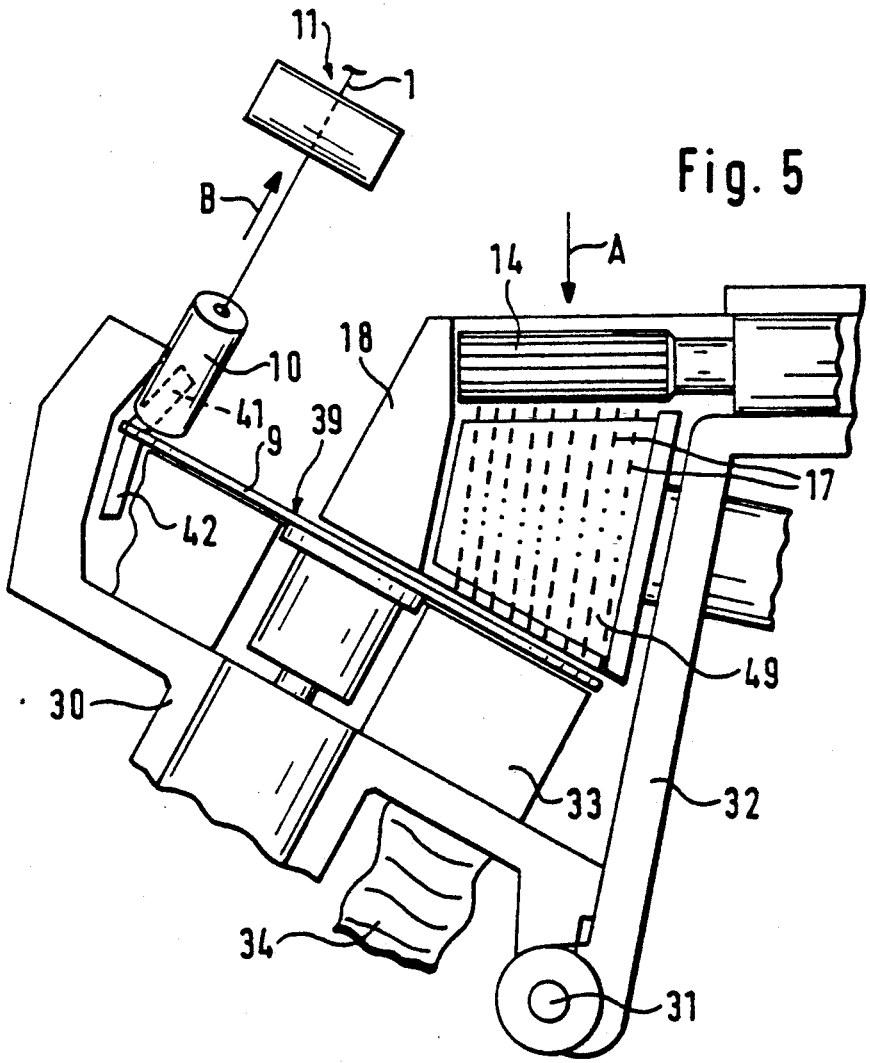
FIG. 5 is a schematic view of another preferred embodiment of the invention with a truncated-cone-shaped opening roller.

The embodiment according to FIG. 5, in its basic construction, corresponds to the embodiment according to FIG. 1 to 4 with the difference that a conical opening roller 49 is provided. The shaft of the opening roller 49 which—viewed in the axial direction of the shaft of the disk 9—extends approximately radially with respect to the shaft of the disk 9, is sloped in such a manner with respect to the fiber collecting surface 39 of the disk 9 that the fiber collecting surface 9 extends approximately tangentially with respect to the circumferential surface of the opening roller 49. The larger diameter of the opening roller 49 is at a larger radial distance from the shaft of the disk 9 than the smaller diameter of the opening roller 49. By means of this arrangement, the effect is first obtained that the fibers combed out by the opening roller 49 and separated are already compressed in the circumferential area of the opening roller 49 transversely with respect to their conveying direction because the fibers have the tendency to already travel to the larger diameter of the opening roller 49 in the circumferential area of the opening roller 49. This results in a certain compacting of the fibers transversely with respect to the conveying direction already in the area of the circumferential surface of the opening roller 49 so that the initial width of the fiber collecting surface 39 may be kept smaller than in the arrangement of FIGS. 1–4. In addition, by means of the sloped arrangement of the conical opening roller 49, a certain speed compensation is obtained between the circumferential speed of the disk 9 and the speed of the arriving fibers. It is therefore possible to adapt the speed at which the fibers are fed to the disk 9 to the respective speed of the fiber collecting surface 39 so that, in the radial direction of the disk 9, no higher speed differences exist during the transfer of the fibers.

Also, in the case of the embodiment according to FIG. 6, the basic construction of the arrangement corresponds to the construction according to the embodiment of FIGS. 1 to 4. However, the opening roller 6, with its shaft, is not aligned radially with respect to the shaft of the disk 9 but, on the contrary, is sloped with respect to the shaft of the disk 9 in such a manner that the mouth 50 of the fiber feeding duct 23 connected to the opening roller 6 with one component extends in the circumferential direction of the disk 9. As a result, it is possible that, despite a relatively large working width (z) of the opening roller 6 which is required because of the feeding of several slivers 2 to 5 according to FIG. 1, a suction slot 35 may be provided which has a relatively small initial width (x). In the case of a modified embodiment, a corresponding effect is achieved in that the fiber feeding duct 23 (compare FIGS. 1 and 3), between the opening roller 6 and the disk 9, tapers in the conveying direction, that is, in the direction of the collecting surface 39. As a result, a bundling effect is already obtained during the essentially pneumatic conveying of the fibers after leaving the opening roller 6 and before reaching the disk 9 in the fiber feeding duct 23.

Also the embodiment according to FIG. 7, in its basic construction, corresponds to the embodiment according to FIG. 1 to 4. In addition, a suction roller 53 is arranged between the withdrawal point 40 and the twisting nozzle 10. The shaft of the suction roller 53 extends transversely to the travelling direction (B) of the withdrawn yarn 1. It is arranged at a narrow distance from the disk 9 in such a manner that the withdrawn yarn experiences a deflection, that is, winds around a part of the surface of the suction roller 53. The suction roller 53 is provided with a perforation 54 and a suction insert 55 which is arranged on the inside and is connected to a vacuum source which is not shown. The suction insert 55 has a suction slot 56 which is aimed at the area which faces the yarn 1 and the disk 9. The suction roller 53 is provided with a drive D which drives the suction roller 53 such that its yarn-carrying area moves in the yarn travelling direction (B), specifically at a circumferential speed which is approximately 30% to 60% higher than the withdrawal speed of the yarn 1. The suction roller 53 takes in individual edge fibers 52 which are then taken along by the suction roller 53 at a speed which is higher than the withdrawal speed of the yarn so that these edge fibers 52 are accelerated and move ahead. These edge fibers 52 are therefore, in a defined manner, wound around the yarn 1 which rotates because of the provided false twist and slide on the suction roller 53 so that, after the opening-up of the false twist, they cause a defined winding-around.

In the embodiment according to FIG. 8, the disk 63 which forms a fiber collecting surface has a border 48 which, together with the disk 63, forms a fiber collecting groove 65. The interior wall of the border 48 tapers in the manner of an open-end spinning rotor conically toward the outside so that the fiber collecting groove 65 encloses a vertical and opposite angle of less than 90°.

An opening roller 49 is assigned to the disk 63 and is arranged coaxially with respect to the disk 63. The shaft 61 of the opening roller 49 is disposed inside the shaft of the disk 63 and is equipped with a driving wharve 62. A driving wharve 64 which is concentric with respect to it is assigned to the disk 63.

As illustrated in FIG. 8, the opening roller 49 provided with a mounting 17 tapers in the direction away from the disk 63 in a truncated-cone-shaped manner. It is surrounded by an opening roller housing 57 on which a bearing housing 58 is disposed for a shaft of a feeding roller 14 which is provided with a toothed wheel 59 with which a toothed wheel 60 engages which is driven in a manner not shown in detail.

In the embodiment according to FIG. 8, four slivers 2 to 5 are fed in the direction of the arrow (A) and are combed out and separated by the opening roller 49. The separated fibers float in the channels of the mounting 17 and slide to the disk 63 along the wall of the opening roller housing 57 which widens in the manner of a truncated cone in the direction of the disk 63. The fibers arriving on the disk 63 are subjected to a centrifugal force as a result of which they slide into the fiber collecting groove 65.

The disk 63 with the border 48 and the thus formed fiber collecting groove 65 can also be used in the embodiment according to FIG. 1 to 4 or the embodiments according to FIGS. 5 to 7, according to contemplated embodiments of the invention. In these cases, it may under certain circumstances be sufficient for the effect of the suction device 33, that is, the suction slot 35, to be limited to the area which is opposite the mouth 24 (FIG. 2); 50 (FIG. 6) of a fiber feeding duct 23. After the transfer to the disk 63, the fibers are then released in the axial direction of the disk 63 so that, as a result of the centrifugal forces, they travel very rapidly into the fiber collecting groove 65.

In the embodiment according to FIG. 9, which in its basic construction corresponds to the embodiment according to FIGS. 1 to 4, two feeding and opening devices for several slivers respectively are provided which deliver fibers to the disk 9 by way of mouths 68, 69 of fiber feeding ducts which are not shown. The disk 9 is provided with a suction device which has two suction slots which form fiber collecting surfaces 66, 67 which are basically situated side-by-side and ar aligned approximately in parallel with respect to one another and which are bounded by lateral boundaries 70, 71; 72, 73 of suction slots.

At the withdrawal point 40, a common conical pressure roller 74 is provided which is followed by two twisting nozzles 76, 77 arranged in parallel with respect to one another which are followed by a common withdrawal device 78 withdrawing the yarns 79, 80 in the direction of the arrow (B). As needed, the yarns 79, 80 may be wound up jointly in a side-by-side manner as a double yarn.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A process for spinning staple fibers into a yarn, comprising:

opening up sliver-shaped fiber material into individual fibers and feeding said individual fibers to a collecting surface, moving said collecting surface during said feeding at a speed which corresponds to at least the feeding speed of the individual fibers, conveying the fibers on the collecting surface to a withdrawal point, bundling the fibers into a fiber composite during conveying thereof on the collecting surface via centrifugal forces acting laterally of the conveying direction on the fibers during conveying thereof on the collecting surface, and withdrawing the fiber composite at the withdrawal point while providing said fiber composite with a twist, wherein said withdrawing of the fiber composite at the withdrawal point is in a direction which substantially corresponds to the conveying direction of the fiber composite on the collecting surface at the location of the withdrawal point, and wherein said withdrawing of the fiber composite at the withdrawal point is at a speed substantially equal to the conveying speed of the collecting surface.

2. A process according to claim 1, comprising preventing a travelling-back of the twist in the withdrawn fiber composite in the area of the withdrawal point.

3. A process according to claim 2, wherein said sliver-shaped fiber material includes a plurality of slivers, wherein said opening includes simultaneously opening up the plurality of slivers into individual fibers, and wherein said feeding includes guiding said individual fibers to a common collecting surface.

4. A process according to claim 1, comprising providing a twist to the fiber composite which travels back beyond the withdrawal point.

5. A process according to claim 4, wherein said sliver-shaped fiber material includes a plurality of sliver, wherein said opening includes simultaneously opening up the plurality of slivers into individual fibers, and wherein said feeding includes guiding said individual fibers to a common collecting surface.

6. A process according to claim 1, wherein said sliver-shaped fiber material includes a plurality of slivers, wherein said opening includes simultaneously opening up the plurality of slivers into individual fibers, and wherein said feeding includes guiding said individual fibers to a common collecting surface.

7. A process according to claim 6, wherein said feeding includes feeding four of said slivers to the common collecting surface.

8. A process according to claim 1, comprising pneumatically twisting the yarn downstream of the withdrawal point.

9. A process according to claim 1, wherein said collecting surface is disposed on a rotatable disk, and wherein said bundling includes subjecting the fibers to a centrifugal force by rotating the disk.

10. A process according to claim 9, wherein said collecting surface extends over only a portion of a circumference of the disk, and wherein said bundling includes reducing the radial width of the fibers on the collecting surface as the fibers and collecting surface travel between a fiber feeding point and the withdrawal point.

11. Apparatus for spinning staple fibers into a yarn, comprising:

a feeding and opening device which opens up sliver shaped fiber material into individual fibers, a collecting device for the individual fibers arranged downstream of the feeding and opening device, said collecting device having a collecting surface and moving apparatus for moving the collecting surface substantially in the feeding direction of the individual fibers so as to cause bundling of the fibers into a fiber composite during conveying thereof on the collecting surface via centrifugal forces acting laterally of the conveying direction on the fibers during conveying thereof on the collecting surface, said fiber collecting surface extending from a feeding point to a withdrawal point, a withdrawal device which follows the withdrawal point, and a twist-providing device for providing a twist between the collecting surface and the withdrawal device, wherein the withdrawal device and the twist providing device are arranged such that the yarn withdrawal direction corresponds substantially to the moving direction of the collecting surface in the area of the withdrawal point.

12. Apparatus according to claim 11, wherein the collecting device is an axially perforated disk to which a suction device is assigned which is arranged on the side facing away from the feeding and opening device and which has a suction slot tapering from the area of the feeding point to the withdrawal point.

13. Apparatus according to claim 12, wherein a pressure roller is arranged at the withdrawal point and forms a clamping point with the disk.

14. Apparatus according to claim 13, wherein a counterpressure roller is arranged which supports the disk at the withdrawal point on the side situated opposite the pressure roller.

15. Apparatus according to claim 12, wherein the suction slot is extended beyond the withdrawal point.

16. Apparatus according to claim 12, wherein the disk is provided with an essentially axially directed border which forms a collecting groove.

17. Apparatus according to claim 12, wherein the feeding and opening device has an opening roller with a working width permitting a feeding of several slivers travelling side-by-side.

18. Apparatus according to claim 17, wherein the width of the suction slot at the feeding point corresponds to at least approximately the working width of an opening roller of the feeding and opening device.

19. Apparatus according to claim 18, wherein a rotating shaft of the opening roller, viewed in the axial direction of the disk, extends at an angle with respect to a radial line of the disk.

20. Apparatus according to claim 17, wherein a rotating shaft of the opening roller, viewed in the axial direction of the disk, extends at an angle with respect to a radial line of the disk.

21. Apparatus according to claim 17, wherein the opening roller has a truncated-cone-shaped circumferential surface.

22. Apparatus according to claim 12, wherein the suction device has two suction slots which extend approximately in parallel between the feeding point and withdrawal point.

23. Apparatus according to claim 11, wherein the collecting device is a disk, and wherein a pressure roller is arranged at the withdrawal point and forms a clamping point with the disk.

24. Apparatus according to claim 23, wherein a counterpressure roller is arranged which supports the disk at the withdrawal point on the side situated opposite the pressure roller.

25. Apparatus according to claim 11, wherein the feeding and opening device has an opening roller with a working width permitting a feeding of several slivers travelling side-by-side.

26. Apparatus according to claim 25, wherein the opening roller has a truncated-cone-shaped circumferential surface.

27. Apparatus according to claim 11, wherein a roller is arranged between the withdrawal point and a device for providing the twist, comprising suction apparatus for subjecting said roller to suction, said roller forming a yarn deflection, and wherein a driving device is provided for driving the roller at a circumferential speed which is higher than the withdrawal speed.

28. Apparatus according to claim 11, wherein said collecting device includes a substantially disk shaped surface which forms the collecting surface.

29. Apparatus according to claim 28, wherein the withdrawal point is spaced circumferentially of the feeding point by only a portion of the circumference of the disk shaped surface.

30. Apparatus according to claim 29, wherein said collecting surface, feeding point and withdrawal point are configured to effect a bundling of fibers on the collecting surface which is aided by centrifugal forces induced by rotation of the collecting surface with said fibers disposed on a tapered section of the disk shaped surface, said tapered section extending from its widest point at the feeding point to its narrowest point at the withdrawal point.

31. Apparatus according to claim 30, wherein the collecting device is an axially perforated disk to which a suction device is assigned which is arranged on the side facing away from the feeding and opening device and which has a suction slot tapering from the area of the feeding point to the withdrawal point.

* * * * *